US011052983B2

(12) United States Patent
Carter

(10) Patent No.: US 11,052,983 B2
(45) Date of Patent: Jul. 6, 2021

(54) MARINE PROPULSION SYSTEM

(71) Applicant: DUODRIVE LIMITED, Tunbridge Wells (GB)

(72) Inventor: John Carter, St. Martin (GB)

(73) Assignee: DUODRIVE LIMITED, Tunbridge Wells (GB)

( * ) Notice: Subject to any disclaimer, the term of this patent is extended or adjusted under 35 U.S.C. 154(b) by 105 days.

(21) Appl. No.: 16/305,560

(22) PCT Filed: Jun. 8, 2017

(86) PCT No.: PCT/GB2017/051665
§ 371 (c)(1),
(2) Date: Nov. 29, 2018

(87) PCT Pub. No.: WO2017/212274
PCT Pub. Date: Dec. 4, 2017

(65) Prior Publication Data

US 2020/0324869 A1 Oct. 15, 2020

(30) Foreign Application Priority Data

Jun. 8, 2016 (GB) ..... 1610020

(51) Int. Cl.
*B63H 21/30* (2006.01)
*B63H 23/32* (2006.01)
*B63H 23/10* (2006.01)

(52) U.S. Cl.
CPC ..... *B63H 23/10* (2013.01); *B63H 21/30* (2013.01); *B63H 23/321* (2013.01)

(58) Field of Classification Search
CPC ..... B63H 23/10; B63H 21/30; B63H 23/321; B63H 2005/106; B63H 2023/323; B63H 23/02; B63H 2021/307
(Continued)

(56) References Cited

U.S. PATENT DOCUMENTS 2,630,094 A * 3/1953 Hacker ..... B63H 23/36 440/82
3,896,757 A 7/1975 Kucher
(Continued)

FOREIGN PATENT DOCUMENTS

CA 2255125 A1 11/1997
GB 2046689 A 11/1980
(Continued)

*Primary Examiner* — Anthony D Wiest
(74) *Attorney, Agent, or Firm* — Conley Rose, P.C.

(57) ABSTRACT

There is disclosed a marine propulsion system for a shaft-driven boat. The system includes a recess formed in the hull of the boat, and a drive cassette. The drive cassette includes: a housing; a static tube extending rearwardly from the housing and fixed relative thereto; and at least one drive shaft extending through the static tube and into the housing. The drive shaft is supported for rotation within the static tube by at least one shaft bearing, and is rotatably supported within the housing by thrust bearings. The static tube, the drive shaft, the or each shaft bearing, and the thrust bearings are all coaxially aligned with one another. The housing and the recess are mutually configured such that the housing may be engaged within the recess to install the drive cassette within the drivetrain of the boat.

21 Claims, 3 Drawing Sheets

(58) Field of Classification Search
USPC ..... 440/76, 78
See application file for complete search history.

(56) References Cited

U.S. PATENT DOCUMENTS

| | | | | |
|---|---|---|---|---|
| 4,790,782 | A | 12/1988 | McCormick | |
| 4,854,903 | A | 8/1989 | Sirois | |
| 5,848,921 | A | 12/1998 | Mochida | |
| 2008/0214068 | A1* | 9/2008 | Stolper ..... | B63H 23/321 440/75 |

FOREIGN PATENT DOCUMENTS

| | | | |
|---|---|---|---|
| GB | 2368056 | A | 4/2002 |
| WO | 9743173 | A1 | 11/1997 |

* cited by examiner

MARINE PROPULSION SYSTEM

The present invention relates to a marine propulsion system, and more particularly relates to a marine propulsion system for a shaft-driven boat.

There are various different types of known propulsion and drive arrangements available for boats. One such system is a so-called Straight Shaft Inboard system, and comprises an inboard-mounted engine which is coupled to a straight drive shaft which extends aft, and often downwardly, from the engine. The shaft passes through the boat's hull, and is supported towards its free end, in the region of the propeller which is mounted to the end of the shaft, by a bracket. A separate rudder is mounted to the hull at a position immediately aft of the propeller.

FIG. 1 illustrates a conventional shaft-drive arrangement of the type described above, installed in a boat having a hull 1. The engine 2 in this type of arrangement is typically mounted inboard, and significantly forward of the boat's propeller 3. The propeller is mounted to the aft end of a straight drive shaft 4, and the drive shaft 4 extends forwardly from the propeller 3 and passes through a sealed aperture 5 (sometimes referred to as a "stern tube") in the boat's hull, and extends towards the engine 2 for connection to a gearbox 6, which is conventionally mounted to the aft end of the engine 2 in this type of Straight Shaft Inboard system. Another, more compact, arrangement has a V-configuration gearbox such that the engine is arranged to face the opposite direction and is mounted above the shaft-drive. In both of these types of arrangement, the aft end of the drive shaft is supported by a propeller bracket 7, which is sometimes referred to as a P-bracket, and which is secured to the underside of the hull 1. As will be appreciated by those of skill in the art, the drive shaft 4 is conventionally connected to the gearbox 6 via a rigid coupling, illustrated generally at 8 in FIG. 1.

Whilst conventional arrangements such as those described above, and illustrated in FIG. 1, are relatively simple, and are widely used in the marine industry, they are not without problems. One problem is that the torque and thrust generated by rotation of the propeller 3 is directed to the boat's hull 1 via the gearbox 6 the engine 2, as denoted by the arrows marked T in FIG. 1, and hence also through the engine mounts (not shown) which are used to mount the engine to the structure of the hull 1. Whilst rigid engine mounts would provide the most efficient transmission of thrust to the hull, they would also transmit unacceptable levels of vibrations to the hull. This type of installation therefore usually comprises semi-rigid engine mounts (not shown), with the rigidity of the mounts being selected as a compromise between the efficient transmission of thrust to the hull, and effective vibration damping. The need to ensure that the engine mounts can absorb sufficient vibration, reduces the effective transmission of thrust to the boat's hull 1.

Another problem arises from the need to accurately align various components of the driveline installation, which becomes exacerbated by the length of the entire installation, and thus the axial spacing of the various components. As will be appreciated, the drive shaft 4, the static tube, the propeller bracket 7, the sealed aperture 5, various bearings associated therewith, the thrust bearing arrangement 8, and the gearbox must all be very accurately aligned with one another, over a very significant length (denoted L in FIG. 1). This can be very difficult and time-consuming to achieve when the driveline is installed in the boat, and can sometimes be difficult to maintain during service due to the fact that the boat's hull 1 will inevitably flex and deform slightly when the boat is underway, particularly in a heavy seaway. Even very slight misalignment between these various components can result in the boat suffering from a reduction in driving thrust, which will of course reduce the fuel efficiency of the boat in service.

Another problem which can arise in some conventional installations of the type described above, is the shear length L of the driveline, which means that the engine must be located quite a significant distance forward of the sealed aperture 5 through which the drive shaft 4 enters the hull 1, in order to permit proper alignment of the gearbox 6 with the shaft 4. This can have implications for the overall arrangement of the boat, because space aboard is often limited.

The present invention seeks to provide an improved marine propulsion system.

According to a first aspect of the present invention, there is provided a marine propulsion system for a shaft-driven boat, the system comprising a recess formed in the hull of a said boat, and a drive cassette, said drive cassette comprising: a housing; a static tube extending rearwardly from said housing and fixed relative thereto; and at least one drive shaft extending through said static tube and into the housing; the drive shaft being supported for rotation within the static tube by at least one shaft bearing, and being rotatably supported within the housing by thrust bearings; said static tube, said drive shaft, the or each said shaft bearing, and said thrust bearings all being coaxially aligned with one another; wherein said housing and said recess are mutually configured such that said housing may be engaged within said recess to install said drive cassette within the drivetrain of the boat.

Conveniently, said recess is an external recess such that said housing may be engaged within the recess from outside the hull of the boat.

Said recess may be provided below the waterline of the boat.

Optionally, said cassette further comprises a fairing around at least part of said static tube, said fairing being configured for connection to the hull of the boat.

In some embodiments, said drive cassette comprises a single said drive shaft.

In other embodiments, said drive cassette comprises a pair of drive shafts arranged coaxially and for contra-rotation relative to one another, said pair of drive shafts comprising a primary drive shaft and a secondary drive shaft, said primary drive shaft extending through said secondary drive shaft and the housing for connection to a source of propulsive power, and said secondary drive shaft extending through said static tube and into the housing, wherein each said drive shaft is rotatably supported within said housing by respective sets of thrust bearings, and said housing contains a gear train which mechanically interconnects said shafts and which is configured to drive said secondary shaft in the opposite direction to said primary shaft.

Said gear train may be configured to drive said secondary shaft at the same speed as said primary shaft.

Alternatively, said gear train may be configured to drive said secondary shaft at a different speed to said primary shaft.

Conveniently, said static tube, said primary and secondary drive shafts, the or each said shaft bearing, and said thrust bearings are all coaxially aligned with one another.

Advantageously, said drive train interconnecting said drive shafts comprises a primary gear mounted to said primary drive shaft, a secondary gear mounted to said secondary drive shaft, said primary and secondary gears being arranged in facing relationship to one another and being mechanically interconnected by a pair of opposed pinion gears.

Optionally, said primary driven gear and said secondary gear are both crown gears, and said pinion gears are both straight-cut gears.

Alternatively, said primary driven gear, said secondary gear, and said pinion gears are all bevel gears.

Conveniently, said drive train interconnecting said shafts is located between the sets of thrust bearings associated with each drive shaft.

Advantageously, said drive train includes a torque limiter configured to permit mechanical disengagement of said primary and secondary shafts from one another in response to relative torque between the shafts exceeding a predetermined threshold.

Optionally, said torque limiter is arranged to interconnect said primary gear and said primary shaft for co-rotation.

Said torque limiter may comprise at least one shear pin.

Conveniently, said housing is cylindrical in form.

Advantageously, said housing comprises at least one removable panel.

Preferably, said drive cassette is provided as a self-contained unit for installation within the drivetrain of a boat.

Conveniently, said cassette comprises a respective propeller mounted to the or each said drive shaft.

According to a second aspect of the present invention, there is provided a boat comprising a propulsion system according to the first aspect.

So that the invention may be more readily understood, and so that further features thereof may be appreciated, embodiments of the invention will now be described by way of example with reference to the accompanying drawings in which.

Figure 2:
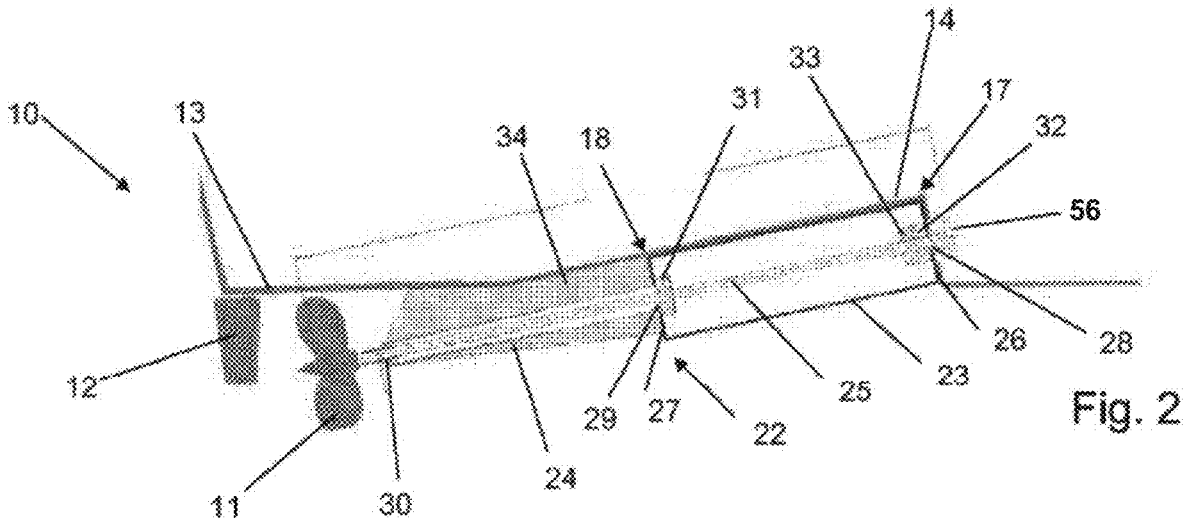
FIG. 2 is a schematic longitudinal cross-sectional view showing a propulsion system in accordance with one embodiment of the present invention, configured for single propeller arrangement.

Turning now to consider FIG. 2 in more detail, there is illustrated a schematic representation of a propulsion system in accordance with an embodiment of the present invention. The aft region of a shaft-driven boat 10 is illustrated, which has a single propeller 11 positioned immediately forward of a rudder 12, the rudder extending downwardly from the aft end of the boat's hull 13 in a conventional manner.

The system of the present invention comprises a recess or "shoe" 14, which is formed in the hull 13 of the boat, in the general region where a conventional drive shaft would normally pass through the hull, from the outside to the inside. It is envisaged that the recess 14 could conveniently be formed during manufacture of the hull 13 in the event that the boat 10 is designed from the outset to have a propulsion system in accordance with the present invention. However, the system of the present invention may also be retro-fitted to existing boats, to replace their conventional drivelines, in which case it envisaged that the hull 10 would require modification by forming the recess 14 prior to installation of the propulsion system. The recess 14 can conveniently be formed in all types of hull 13, including wooden hulls, composite hulls such as those formed from fibre reinforced plastic, or indeed metal hulls such as those formed from aluminium or steel. The recess 14 will generally be formed beneath the waterline of the boat 10, but this is not essential for all installations.

Figure 3:
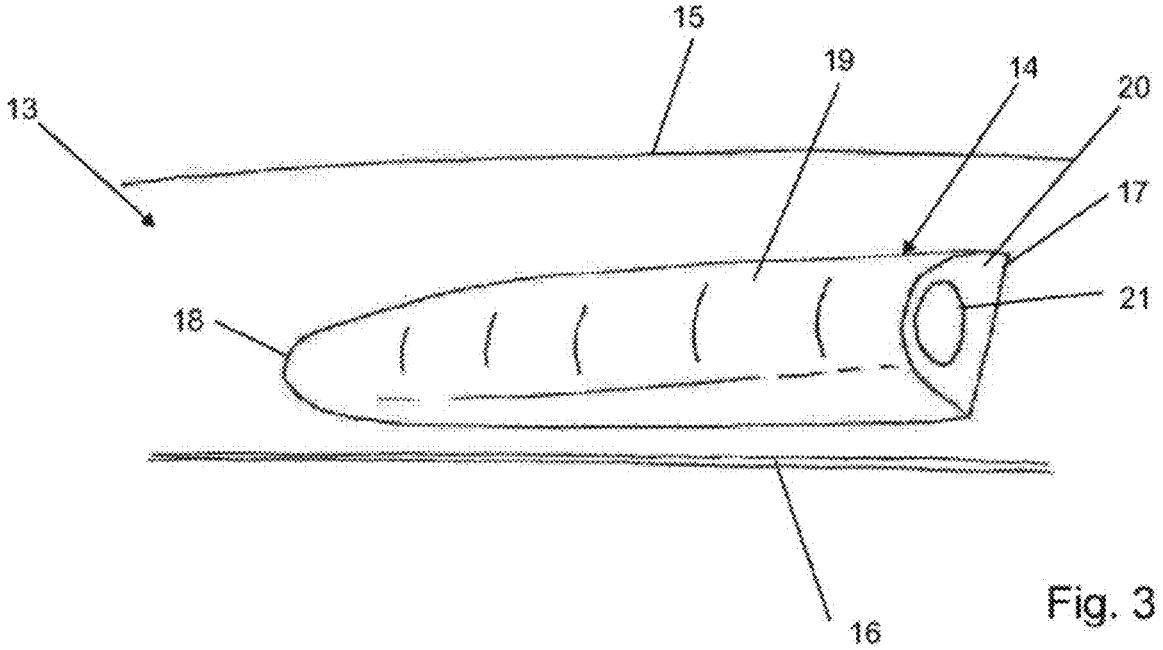
FIG. 3 is a perspective view showing a recess formed in the outside of a boat's hull, and which forms part of the system of the present invention.

FIG. 3 illustrates an example recess 14 which is formed in the underside of a boat's hull 13, as viewed from below the hull 13 looking in an upwards direction. In this particular example, the recess 14 is shown positioned between a strake 15 and a chine 16 of the hull, towards one side of the hull, as might be the case for a so-called "twin screw" boat having a separate drive arrangement and respective propeller on each side of the boat. The recess 14 is tapered such that it is deepest at its forward end 17, and becomes shallower towards its aft end 18, where the recess will preferably blend smoothly with the surrounding region of the hull 13. The recess presents a generally concave and downwardly facing surface 19 along its length, but has a generally planar mounting surface 20 formed at its forward end 17. The downwardly facing concave surface is inclined at an acute angle to the bottom of the boat's hull 13, as illustrated most clearly in FIG. 2, whilst the planar mounting surface 20 at its forward end is generally orthogonal to the concave surface 19. A drive aperture 21 is formed through the hull 13, in the mounting surface 20. As will be appreciated by those of skill in the art, for a "single screw" boat, or a combination of both a "twin & single screw", having a drive arrangement on the centreline of the boat, then the recess 14 may be shaped in a somewhat different manner in order to blend appropriately with the surrounding region of the boat's hull.

Having regard again to FIG. 2, the propulsion system of the present invention further comprises a drive cassette, indicated generally at 22, which is provided in the form of a self-contained unit for installation within the drivetrain of the boat. The principle components of the drive cassette 22 include a housing 23, a static tube 24, and a drive shaft 25.

The housing 23 may take any convenient form, but in the illustrated embodiment takes the form of a hollow elongate cylinder having a pair of oppositely directed planar end walls 26, 27. The cylinder 23 is preferably formed of metal, such as stainless steel, aluminium or titanium, and is sized and shaped so as to be configured for engagement within the recess 14, as illustrated in FIG. 2. As will therefore be noted, the external radius of the cylindrical housing 23 is closely matched to the curvature of the recess surface 19, such that the housing 23 may be accurately received and positioned within the recess 14, from outside the hull 13.

Each end wall 26, 27 of the housing is provided with a respective aperture 28, 29 therethrough, the two apertures being accurately aligned with one another and thus being configured to receive the drive shaft 25 therethrough. As will be noted, when the housing 23 is engaged within the recess 14 formed in the hull 13 as shown in FIG. 2, such that its forward end wall engages and bears against the planar mounting surface 20 of the recess 14, the forward aperture 28 is also accurately aligned with the aperture 21 formed through the hull 13 at the front of the recess 14.

The static tube 24 is elongate and is affixed at its forward end to the rear end wall 27 of the housing 25, around the aft aperture 29 formed therein. The static tube 24 extends rearwardly from the housing 23, such that its longitudinal axis is accurately aligned and coincident with the longitudinal axis of the housing 23.

The drive shaft 25 extends through the static tube 24 and also through the housing 23, via the two end apertures 28, 29, for connection to a source of propulsive power such as an engine. The drive shaft 25 is rotatably supported at the aft end of the static tube by a sealed shaft bearing 30, and projects from the aft end of the static tube by a distance sufficient to permit the propeller to be mounted to the shaft in a conventional manner. The shaft 25 may be rotatably supported within the static tube 24 by other bearings inside the tube, and is also rotatably supported at the aft end of the housing 23 by another shaft bearing 31 which is provided inside the housing against its aft wall 27 and around the aperture 29 formed therein. The forward end of the drive shaft 25 may be supported by a pair of thrust bearings 32, 33, each of which is configured to transmit axial thrust from the shaft in respective directions to the housing, as will be appreciated by those of skill in the art. The thrust bearings 32, 33 are shown arranged in adjacent relationship to one another, with the forward-most thrust bearing 32 being provided against the front wall 26 of the housing, around the aperture 28 formed therein. Of course, it is to be appreciated that the bearings 31, 32, 33 provided inside the housing 23 do not necessarily need to be positioned in the exact locations shown in FIG. 2, and could be spaced from one another, and from the end walls 27, 28 of the housing in a different manner in other embodiments.

The forward-most end of the drive shaft 25 may be provided with a drive flange 56, outside the housing 23, to facilitate connection of the drive shaft to the gearbox of an engine.

The drive cassette 22 may also include a streamlined fairing 34 formed around the static tube 24, and which may be affixed to the housing. In the particular embodiment, the fairing 34 extends the full length of the static tube 24 so as to substantially fully encompass the static tube, and is shaped to compliment the underwater profile of the hull 13.

As indicated above, it is envisaged that the drive cassette 22 will be provided as a self-contained unit, for installation within the drive train of the boat. The drive cassette 22 may thus be conveniently manufactured separately from the boat, for subsequent installation in the boat during final assembly or service, or during a retro-fit operation. The self-contained nature of the drive cassette 22 therefore permits very accurate coaxial pre-alignment of the housing 23, the static tube 24, the shaft bearings 30, 31, and the thrust bearings 32, 33 within the housing, relative to one another, before the cassette 22 is even installed in the boat.

As will be appreciated, the pre-aligned and self-contained nature of the drive cassette 22 therefore offers very significant advantages when it comes to installation in the boat. It is envisaged that for relatively large boats, and/or when lifting the craft may not be possible, the drive cassette 22 may be installed without the need to dry dock the boat; for example by divers. In order to achieve this, it is proposed to cap the recess aperture 21 in a substantially watertight manner by applying a so-called sea-cap (not shown) over the aperture 21, from inside the hull 13, in a manner known per se.

Once the hull recess 14 has been prepared, the entire pre-assembled drive cassette 22 may be offered-up towards the underside of the boat's hull, and the housing 23 aligned with the recess 14. The housing 23 will then be inserted into the recess, such that its curved outer surface engages the curved surface 19 of the recess 14. Some axial manipulation of the cassette may be required in order to pass the forward end of the drive shaft 25, and its drive flange 56, through the recess aperture 21 and into the void defined by the sea-cap (if used). The housing 23 will be manipulated such that its forward end wall 26 engages and bears against the planar surface 20 of the recess, and thereafter may be securely bolted or otherwise fixed in position within the recess. It is envisaged that in some embodiments this may be achieved by passing bolts through the planar surface 20 of the recess, from inside the hull, the bolts being threadedly engaged within corresponding recesses formed in the front wall 26 of the housing.

Once the housing 23 has been securely engaged within the hull recess 14, the fairing 34 will locate neatly against the undersurface of the boat's hull 13, and may be connected directly to the hull in any convenient manner. All that will then remain to be done, is for the propeller 11 to be mounted to the aft end of the drive shaft 25, and for the forward end of the drive shaft to be connected to the gearbox of the boat's inboard engine. It is to be noted, however, that the propeller 11 could be affixed to the drive shaft 25 prior to installation of the drive cassette 25, such that the propeller 11 may also then be considered to form part of the self-contained drive cassette 22. A preferred type of mechanical connection between the drive shaft 25 and the engine's gearbox will be described in more detail below.

As will therefore be appreciated, the pre-assembled, pre-aligned and self-contained nature of the drive cassette 22 facilitates very straightforward installation within the drive-train of the boat, and ensures that the principle components of the drivetrain such as the static tube 24, the drive shaft 25, the bearings 30, 31 and the thrust bearings 32, 33 are all accurately aligned with one another, thereby avoiding the often difficult task of aligning these components as they are each conventionally installed into the boat separately.

Figure 1:
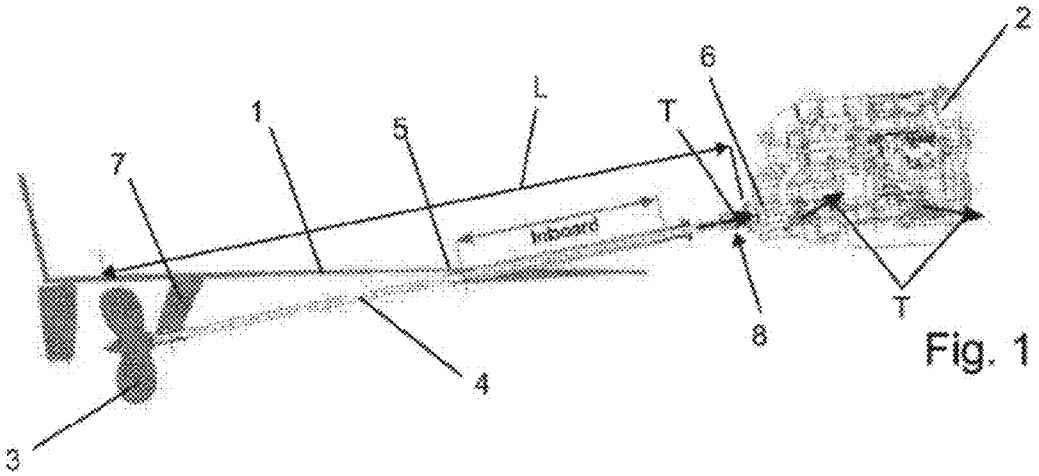
FIG. 1 is schematic longitudinal cross-sectional view showing a conventional propulsion arrangement in a boat having a shaft-drive drivetrain.

Another significant advantage of the cassette-type system of the present invention, arises from the manner in which thrust is transmitted to the boat's hull 13 from the drive shaft 25. The provision of the thrust bearings 32, 33 inside the housing 23 of the cassette 22 means that the thrust will be transmitted via the cassette 22, and then directly to the boat's hull 13 by virtue of the fact that the front wall 26 of the housing 23 is engaged and secured to the surface 20 of the recess 14. This means that the thrust will not be directed through the boat's gearbox and engine, as is the case with most conventional installations of the type illustrated in FIG. 1. This, in turn, helps to reduce the load applied to the engine and gearbox, and permits the use of more flexible engine mounts which can be optimised for their vibration absorption characteristics, given that they will not be required also to transmit thrust from the drive shaft to the boat's hull as is the case with prior art conventional installations.

As will be appreciated, the above-described embodiment comprises a relatively simple drive cassette 22 comprising a single drive shaft 25 suitable for driving a single propeller 11. Of course, it is envisaged that so-called twin-screw boats having two drive shafts (each associated with a respective propeller), could be provided with a propulsion system comprising two drive cassettes 22 of the type described above, for connection to respective gearboxes and engines, or even for connection to the same engine via a more complicated gearbox arrangement for providing drive to both cassettes.

However, the cassette-type system of the present invention is considered to be particularly suitable for use in a contra-rotating propeller drive arrangement, and so other embodiments specifically configured for such use will now be described.

Contra-rotating propeller arrangements are of course well known in the field of marine propulsion, and can offer significant advantages over single propeller arrangements. When a single propeller rotates in water, a significant amount of energy is wasted to the creation of tangential or rotational water flow; effectively twisting the water around. Contra-rotating propellers, on the other hand, help to harness some of this energy by providing another propeller immediately downstream of the main propeller, and driving the downstream propeller in the opposite direction to the upstream one. The downstream propeller can be carefully designed to take advantage of the disturbed water flow created by the upstream propeller, and to harness useful thrust therefrom, thereby improving the overall efficiency of the propeller system. Well-designed contra-rotating propeller arrangements will produce negligible rotational water flow, and thus virtually no torque on the boat.

Figure 4:
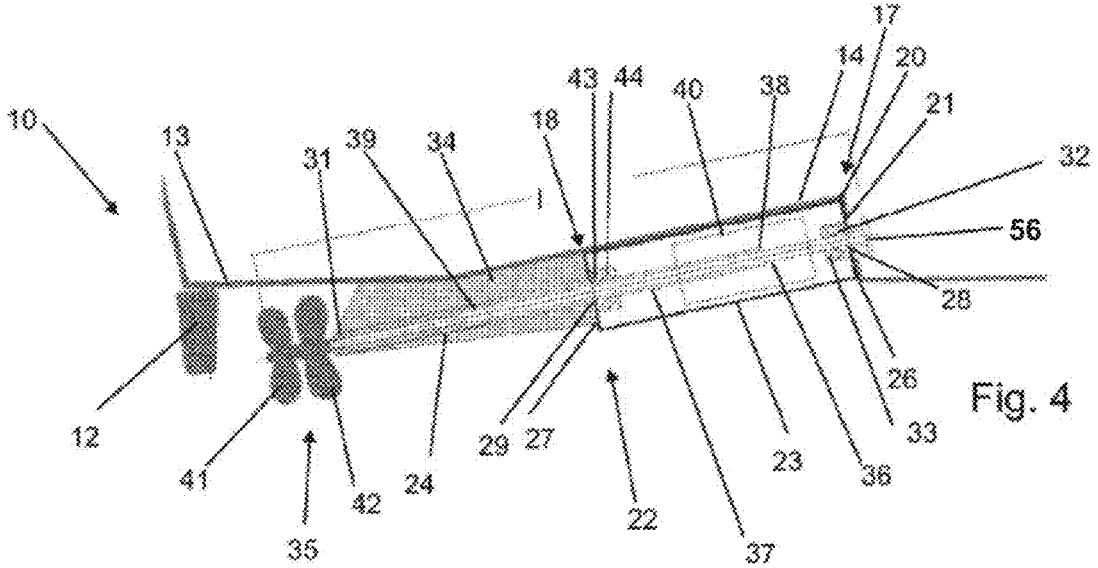
FIG. 4 is a view corresponding generally to that of FIG. 2, but which shows a propulsion system in accordance with another embodiment of the present invention, configured to a drive a pair of contra-rotating propellers.

Turning now to consider FIG. 4, there is illustrated a propulsion arrangement in accordance with another embodiment of the present invention, which is specifically designed for use in driving a contra-rotating propeller arrangement. The system of FIG. 4 is generally similar to the system of FIGS. 2 and 3 in many respects, and effectively represents a modified form thereof, and so the same reference numbers are used to denote identical or similar component parts, some of which need not be described again in detail.

As will be noted, the hull 13 of the boat 10 is thus again formed with a substantially identical recess 14 to that described above with reference to FIGS. 2 and 3. Furthermore, the propulsion system of FIG. 4 also comprises a similar drive cassette 22, which is again provided in the form of a self-contained, pre-assembled, unit.

The drive cassette 22 of this embodiment again comprises a housing 23, and a static tube, but this time comprises two drive shafts, namely a primary drive shaft 36 and a secondary drive shaft 37. The primary drive shaft 36 extends through the static tube 24 and also through the housing 23, via the two end apertures 28, 29 formed in the housing, in a similar manner to the single drive shaft 25 of the arrangement illustrated in FIG. 2, for connection to a source of propulsive power such as an engine. Additionally, however, the primary drive shaft 36 is also arranged so as to extend through the secondary drive shaft 37, which is hollow. More particularly, it will be noted that the secondary drive shaft extends through the static tube, around the primary drive shaft 36, but terminates within the housing 23 such that its forward end 38 is located inside the housing 23. The secondary drive shaft may be rotatably supported at the aft end of the static tube 24 by a sealed shaft bearing 31, and may also be rotatably supported within the static tube by other shaft bearings along its length. The primary shaft 36 may be rotatably supported, as necessary, within the secondary shaft by at least one smaller diameter shaft bearing 39 located within the secondary shaft 37. The secondary shaft 37 is thus supported for rotation within the static tube 24, whilst the primary shaft 36 is supported for rotation within and relative to the secondary tube 24, and thus also for rotation relative to the static tube 24.

The two drive shafts 36, 37 are mechanically interconnected by a drive train, indicated generally at 40 in FIG. 4, which is provided within the housing 23 and which is configured to drive the secondary shaft 37 in the opposite direction to the primary shaft 36. As will therefore be noted, the drive shafts 36, 37 are thus arranged coaxially and for contra-rotation relative to one another. The gear train 40 will be described in more detail below.

The downstream propeller 41 of the contra-rotating propeller arrangement 35 is connected to the aft end of the primary shaft 36 which projects outwardly from the secondary shaft 37, and the upstream propeller 42 is connected to the aft end of the secondary shaft, which projects from the static tube 24 and which terminates immediately upstream of the downstream propeller 41. When the drive shafts 36, 37 are driven in opposite directions, the two propellers will thus be rotated in opposite directions.

Because both drive shafts 36, 37 of this arrangement will be driven (in opposite directions), each drive shaft 36, 37 is associated with its own respective pair of thrust bearings located within the housing, in order to transmit axial thrust from the respective shaft to the housing. In the arrangement illustrated, a pair of primary thrust bearings 32, 33 (which may be substantially identical to the thrust bearings of the previously described embodiment) support the forward end of the primary drive shaft and are located adjacent the front end wall 26 of the housing, and a pair of secondary thrust bearings 43, 44 support the secondary shaft 37 and are located adjacent the aft end wall 27 of the housing 23. As will be noted, the two sets of thrust bearings 32, 33 and 43, 44 are thus located on opposite sides of the gear train 40 provided within the housing, such that the gear train 40 is located between the two sets of thrust bearings.

The drive cassette 22 will be pre-assembled such that its static tube 24, both drive shafts 36, 37, all shaft bearings 31, 39, and the thrust bearings 32, 33, 43, 44 are all accurately coaxially aligned with one another. As will be appreciated, the drive cassette 22 of the second embodiment is thus again provided as a self-contained unit for installation within the drive train of a boat, and may be installed in exactly the same manner as the drive cassette of the first embodiment. Although the drive cassette 22 of the second embodiment is somewhat more complicated than that of the first embodiment, due its contra-rotating drive arrangement, its self-contained and pre-aligned configuration does not complicate its installation in any respect.

Figure 5:
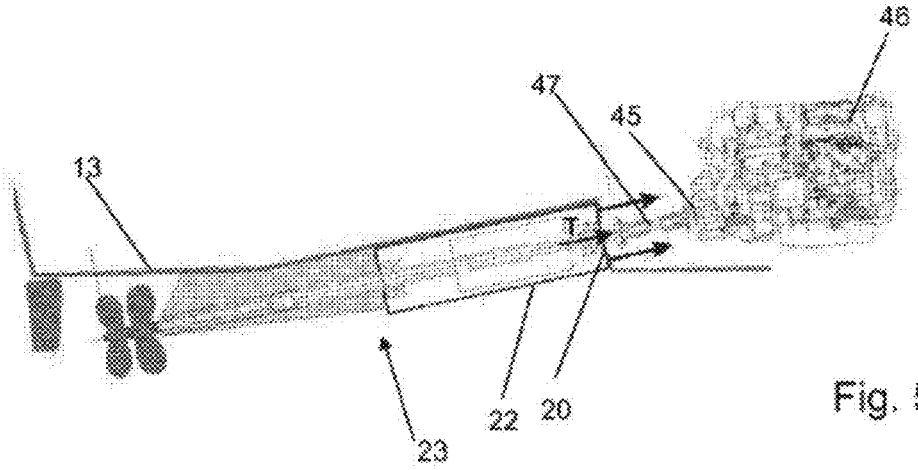
FIG. 5 is a view similar to that of FIG. 4, but which shows the propulsion system connected to a source of propulsive power in the form of an inboard engine.

FIG. 5 illustrates the drive cassette 22 of the second embodiment installed and connected to the gearbox 45 and engine 46 of the boat. It is envisaged that the forward end of the primary drive shaft 36 (or the forward end of the sole drive shaft in the case of the first embodiment illustrated in FIG. 2) will be connected to the gearbox 45 via a cardan shaft 47. As will be noted, the self-contained nature of the drive cassette 22 permits the overall length of the boat's drive train, denoted 'I' in FIG. 4, to be considerably shorter than that of the conventional drive train installation 1' illustrated in FIG. 1, which can bring significant advantages in terms of the layout and use of space aboard the boat as it permits the engine to be located closer to the aperture 20 through the hull.

FIG. 5 also illustrates schematically the manner in which the system of the present invention facilitates the transmission of thrust and torque (indicated by the arrows denoted T) directly to the boat's hull 13 via its connection to the housing 23, rather than through the gearbox 45, engine 46 and the engine mounts (not shown).

Figure 6:
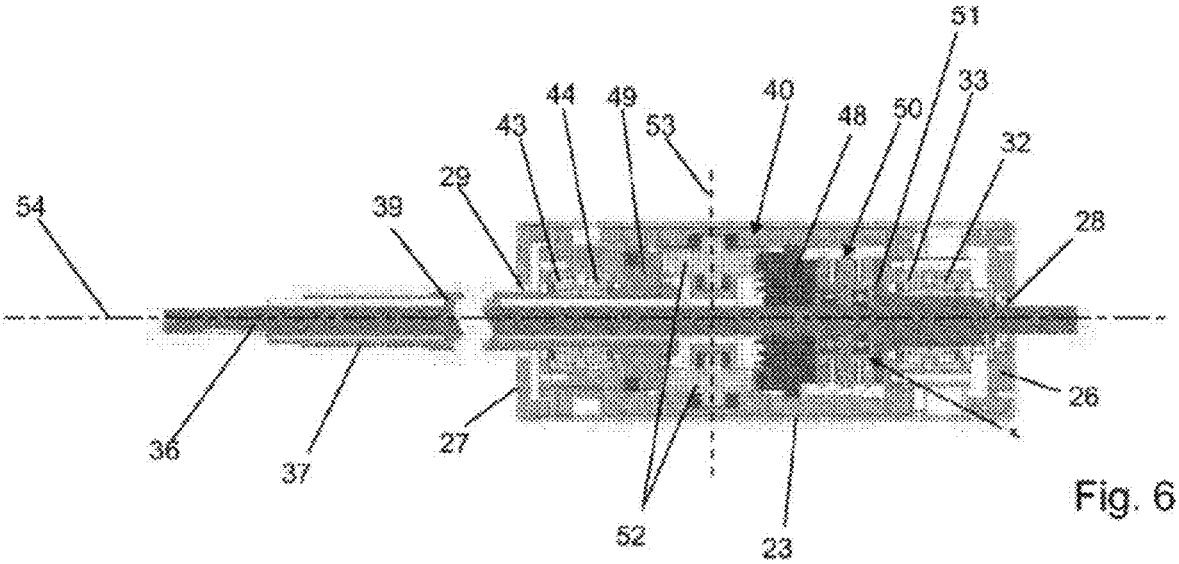
FIG. 6 is a more detailed longitudinal cross-sectional illustration showing the internal components of a drive arrangement in accordance with an embodiment of the present invention.

Turning now to consider FIG. 6, the contra-rotation gear train 40 inside the housing 23 will now be described in more detail.

The gear train 40 comprises a primary gear 48 and a secondary gear 49, which are arranged in axially spaced-apart and facing relation to one another. In some embodiments, it is envisaged that the primary gear 48 and the secondary gear 49 will both be crown gears, with their respective sets of gear teeth arranged in facing relation to one another. However, in other embodiments the primary and secondary gears 48, 49 could instead take the form of bevel gears.

The primary gear 48 is mounted to the primary drive shaft 36 for co-rotation therewith. In the particular embodiment illustrated in FIG. 6, this is achieved via a torque limiter 50. The torque limiter 50 can take any convenient form, but in the particular arrangement illustrated in FIG. 6 is shown to take the form of a so-called Howdon Wedgegard™ torque limiter, of a type known per se. The illustrated torque limiter 50 thus comprises a plurality of shear pins which are configured to fail upon the application of a predetermined load. The torque limiter 50 is arranged between the primary gear 48 and a flange 51 which is fixedly connected to the primary shaft 36 for co-rotation therewith. One side of the torque limiter 50 is connected to the primary gear 48, and the other side of the torque limiter 50 is connected to the flange 51. When the shear pins of the torque limiter 50 are intact, the torque limiter 50 thus interconnects the primary gear 48 and the primary shaft 36 for co-rotation.

The secondary gear 49 is mounted to the forward end of the secondary shaft 37 for co-rotation therewith, and does not require a torque limiter.

A pair of substantially identical pinion gears 52 are provided between the primary and secondary gears 48, 49. The pinion gears are spaced apart from one another across the primary shaft 36, and are mounted within the housing for rotation about a common axis 53 which is orthogonal to the axis 54 of the primary shaft 36. The pinion gears 52 are arranged such that their sets of teeth mesh with the teeth of both the primary gear 48 and the secondary gear 49, the pinion gears 52 thereby mechanically interconnecting the primary and secondary gears 48, 49.

As will be appreciated, in embodiments in which the primary and secondary gears 48, 49 are both bevel gears, the pinion gears will both also take the form of bevel gears. However, in the illustrated arrangement in which the primary and secondary gears 48, 49 are both provided as crown gears, it is envisaged that the pinion gears 52 will be simple straight-cut gears. This offers advantages to the gear train of this arrangement, because it avoids the application of loads to the pinion gears 52 which would tend to urge them further apart from one another. In currently favoured embodiments, it is envisaged that the primary and secondary gears 48, 49 and the pinion gears 52 will all be so-called CYLKRO™ gears, of a type known per se.

As will be appreciated, when the primary shaft is driven by the engine 46, it will be rotated about its axis, thereby rotating the aft propeller 41 in a first direction. The primary gear 48 will thus rotate in the same direction as the primary shaft 36, and turn the pinion gears 53, which in turn will cause the secondary gear 49, and hence also the secondary shaft 37, to rotate in the opposite direction, thereby driving the upstream propeller 42 in the opposite direction to the downstream propeller 41.

The torque limiter 50 is provided as a safety measure, to permit disengagement of the gear train 40 interconnecting the two shafts 36, 37 in the event of a mechanical failure occurring somewhere in the gear train 40, such as gear teeth fracturing or the like which could jam the gear train. Such an event would create a large increase in the relative torque between the two shafts, which if it were to exceed a predetermined threshold level would therefore cause the shear pins of the torque limiter 50 to fail, thereby disconnecting the primary gear from the primary shaft 36, which would then permit the primary shaft 36 to continue to rotate freely relative to the gear train 40, under the power of the engine, and thereby continue to drive the downstream propeller 41. The boat would thus still be capable of propulsion under its own power, albeit at reduced efficiency and with reduced thrust.

As will be appreciated, it is advantageous to provide access to the gear train 40 inside the housing for repair and maintenance purposes. It is therefore proposed to provide the housing 23 with one or more removable or openable panels. These may either be provided in the side of the housing, or could be provided in the form of removable end walls 26, 27.

Also, it will be noted that the above-described gear train 40 is configured to drive the primary and secondary shafts 36, 37 in opposite directions, but at the same rotational speed as one another. Other embodiments are envisaged in which the gear train 40 could be configured to drive the secondary shaft 37 at a different speed to the primary shaft 36. This could be achieved, for example, by replacing the simple pinion gears 52 illustrated with stepped pinion gears, each presenting two sets of CYLKRO™ teeth arranged around different diameter parts of the pinion. Stepped pinion gears of this type could then be arranged to mechanically interconnect primary and secondary gears 48, 49 of different diameter.

It is to be appreciated that whilst the present invention has been described above with particular reference to particular embodiments, various changes or modifications could be made without departing from the scope of the invention as defined by the appended claims. For example, it is envisaged that the drive cassette 22 of some embodiments may not include a complete fairing 34 around the static tube 24 as described above, and could instead comprise a generally conventional P-bracket pre-assembled at the aft end of the static tube 24. Such an arrangement is illustrated, for example in FIG. 7, where the P bracket 54 is shown mounted to aft end of the static tube.

Figure 7:
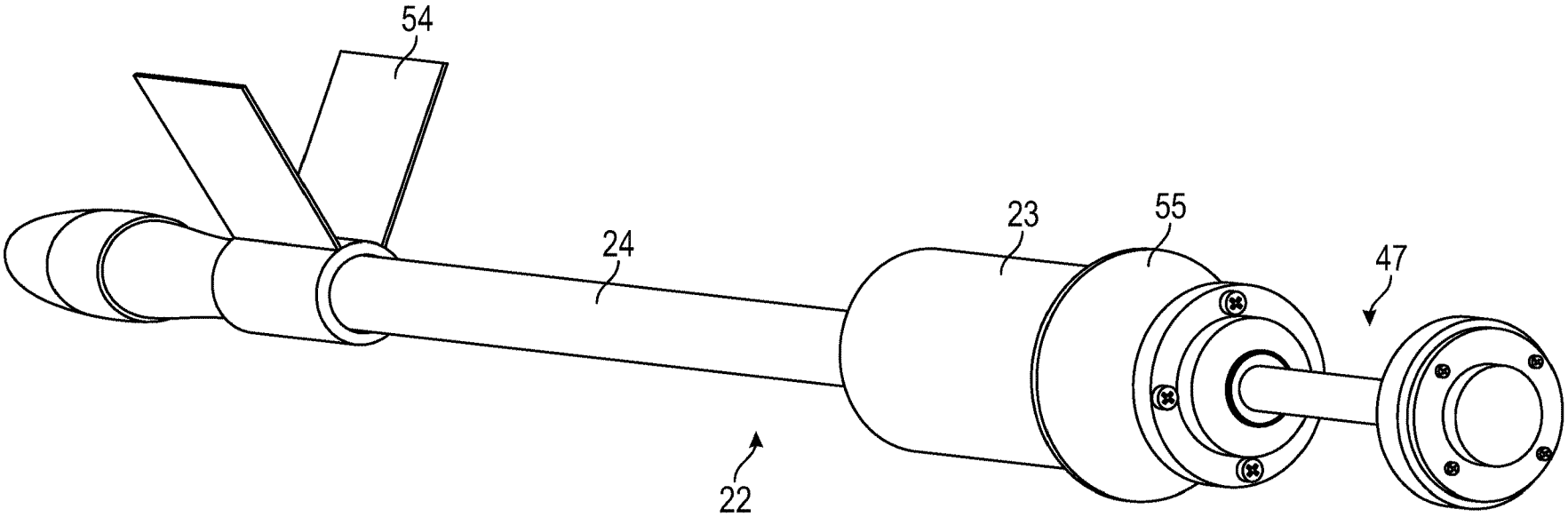
FIG. 7 is a perspective illustration showing a self-contained drive cassette which may form part of the propulsion system of the present invention.

FIG. 7 also illustrates another optional feature, in the form of a thrust and torque sensor arrangement. The sensor arrangement may take the form of a so-called torque flange 55, which is shown in FIG. 7 affixed to the forward end wall 26 of the housing 23. When the drive cassette 22 is installed in the boat in the manner described above, the torque flange will thus be located between the forward wall 26 of the housing and the planar surface 20 of the hull inside the recess 14. The torque flange will thus be positioned to give accurate signals representative of both the thrust applied to the boat's hull 13, and the relative torque between the primary and secondary drive shafts 36, 37 of the contra-rotating embodiment. This is facilitated by the manner in which the housing 22 containing the gear train 40 is connected directly to the boat's hull 13 and thus transmits thrust directly to the hull. It has not been possible to conveniently monitor the relative torque between the two drive shafts of a contra-rotating propeller arrangement with conventional drive installations, nor the axial thrust delivered. A similar torque flange 55 could also be fitted to single propeller cassette 22 of the type illustrated in FIG. 2.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A marine propulsion system comprising:

a boat having a recess formed along an external surface of a hull of the boat, wherein the boat has an engine; and a drive cassette comprising:

a housing;

a static tube fixably attached to the housing and extending rearwardly from the housing;

and a drive shaft extending through the static tube and into the housing;

wherein the drive shaft is rotatably supported by a shaft bearing within the static tube, wherein the drive shaft is rotatably supported by a pair of thrust bearings disposed within the housing outside the hull and configured to transfer axial thrust from the drive shaft to the housing;

wherein the static tube, the drive shaft, the shaft bearing, and the pair of thrust bearings are coaxially aligned with each other;

wherein the housing is seated in the recess and an end of the driveshaft is coupled to the engine of the boat.

2. The marine propulsion system of claim 1, wherein said recess is an external recess such that said housing is engaged within the recess from outside the hull of said boat.

3. The marine propulsion system of claim 2, wherein said recess is below a waterline of said boat.

4. The marine propulsion system of claim 1, wherein said drive cassette further comprises a fairing around at least a portion of the static tube, said fairing connected to the hull of said boat.

5. The marine propulsion system of claim 1, wherein said at least one drive shaft is a single drive shaft.

6. The marine propulsion system of claim 1, wherein said at least one drive shaft is a pair of drive shafts arranged coaxially and contra-rotatably relative to one another, the pair of drive shafts comprising a primary drive shaft and a secondary drive shaft, the primary drive shaft extending through the secondary drive shaft and said housing and adapted to connect to a source of propulsive power, the secondary drive shaft extending through the static tube and into said housing, wherein each of said pair of drive shafts is rotatably supported within said housing by respective sets of the thrust bearings, wherein said housing contains a gear train which mechanically interconnects the pair of drive shafts and is configured to drive the secondary drive shaft in a rotational direction opposite to a rotational direction of the primary drive shaft.

7. The marine propulsion system of claim 6, wherein said gear train drives the secondary drive shaft at a speed identical to a speed of the primary drive shaft.

8. The marine propulsion system of claim 6, wherein said gear train drives the secondary drive shaft at a speed different than a speed of the primary drive shaft.

9. The marine propulsion system of claim 6, wherein said static tube, the primary and secondary drive shafts and the at least one shaft bearing and the thrust bearings are all coaxially aligned with one another.

10. The marine propulsion system of claim 6, wherein said drive train comprises a primary gear mounted to said primary drive shaft and a secondary gear mounted to said secondary drive shaft, the primary and secondary gears being arranged in facing relationship to one another and being mechanically interconnected by a pair of opposed pinion gears.

11. The marine propulsion system of claim 10, wherein the primary gear and said secondary gear are each crown gears and the pair of opposed pinion gears are each straight-cut gears.

12. The marine propulsion system of claim 10, wherein the primary gear, the secondary gear, and the pair of opposed pinion gears are each bevel gears.

13. The marine propulsion system of claim 6, wherein the drive train is located between the sets of the thrust bearings associated with each of the pair of drive shafts.

14. The marine propulsion system of claim 10, wherein the drive train has a torque limiter configured to permit mechanical disengagement of the primary and secondary drive shafts from one another in response to relative torque between the pair of drive shafts exceeding a predetermined threshold.

15. The marine propulsion system of claim 14, wherein the torque limiter interconnects the primary gear and the primary drive shaft for co-rotation.

16. The marine propulsion system of claim 14, wherein the torque limiter comprises at least one shear pin.

17. The marine propulsion system of claim 1, wherein said housing is cylindrical.

18. The marine propulsion system of claim 1, wherein said housing comprises at least one removable panel.

19. The marine propulsion system of claim 1, wherein said drive cassette is a self-contained unit.

20. The marine propulsion system of claim 1, wherein said drive cassette comprises a propeller mounted to the at least one of the pair of drive shafts.

21. The marine propulsion system of claim 1, wherein the housing has a first end engaging the hull proximal the engine and a second end distal the engine;

wherein the static tube has an end fixably attached to the second end of the housing;

wherein the driveshaft has a first end coupled to the engine and a second end coupled to a propeller, wherein the static tube is positioned between the housing and the propeller.

* * * * *